United States Patent [19]

Stubler

[11] Patent Number: 4,972,228

[45] Date of Patent: Nov. 20, 1990

[54] IMAGE FORMING APPARATUS WITH SELECTIVE ERASE

[75] Inventor: Peter O. Stubler, Rochester, N.Y.

[73] Assignee: Eastman Kodak Company, Rochester, N.Y.

[21] Appl. No.: 417,493

[22] Filed: Oct. 5, 1989

[51] Int. Cl.[5] ..... G03G 21/00

[52] U.S. Cl. ..... 355/218; 355/202; 355/210

[58] Field of Search ..... 355/218, 202, 210, 200, 355/69, 77

[56] References Cited

U.S. PATENT DOCUMENTS

| | | | |
|---|---|---|---|
| 4,687,317 | 8/1987 | Appel et al. | 355/218 |
| 4,701,044 | 10/1987 | Horiuchi et al. . | |
| 4,734,789 | 3/1988 | Smith et al. | 355/218 X |
| 4,740,818 | 4/1988 | Tsilibes et al. | 355/218 X |
| 4,763,165 | 8/1988 | Watanabe . | |
| 4,777,510 | 10/1988 | Russel | 355/218 X |
| 4,794,424 | 12/1988 | Higaki et al. . | |
| 4,806,976 | 2/1989 | Kato et al. . | |
| 4,812,874 | 3/1989 | Kubota et al. | 355/218 X |
| 4,837,599 | 6/1989 | Ohira et al. | 355/218 |

*Primary Examiner*—A. T. Grimley
*Assistant Examiner*—Thu Anh Dang
*Attorney, Agent, or Firm*—Lowe, Price, LeBlanc, Becker & Shur

[57] ABSTRACT

An image forming apparatus is disclosed that provide a selective erase feature that enables an operator to block or erase a portion of an original image to be reproduced. The apparatus includes a control unit that generates a set of erase characters based on erase coordinate signals provided by an input unit. The bit map representations of the erase characters are stored in a font memory and are used by the control unit to generate an output data stream that is supplied to an erase unit.

10 Claims, 5 Drawing Sheets

IMAGE FORMING APPARATUS WITH SELECTIVE ERASE

BACKGROUND OF THE INVENTION

The present invention relates to an image forming apparatus capable of reproducing an original image. In particular, the present invention relates to an image forming apparatus that is capable of selectively erasing portions of the original image to be reproduced.

Original images to be reproduced often contain unnecessary or confidential information that the user does not want to appear in the reproduced image. Accordingly, it would be useful to provide an image forming apparatus having a selective erase capability which enables the user to selectively block out or erase portions of the original image from the reproduced image. An example of an image forming apparatus that includes an erase capability is provided in U.S. Pat. No. 4,806,976 issued to Kato et al. It is desirable, however, to provide a selective erase capability wherein a high degree of resolution is achieved in defining the selective erase field and a plurality of selective erase fields can be specified.

SUMMARY OF THE INVENTION

The present invention provides an image forming apparatus incorporating selective erase, wherein the erase field can be defined with a degree of resolution and a plurality of erase fields can be specified.

In particular, the present invention provides an image forming unit that forms an image of an original document on a photosensitive member, an input unit that generates signals indicative of coordinates that correspond to a selected erase field, a control unit that generates a set of erase characters based on the signals generated by the input unit and stores a bit map representation of the erase characters in a font memory, and an erase unit that erases a portion of the image of the original document formed on the photosensitive member that corresponds to the selected erase field in accordance with the bit map representation of the erase characters stored in the font memory.

In operation, the control unit generates and stores a page layout comprising the erase characters arranged in a manner to define the selected erase field in response to the signals generated by the input unit, and sequentially addresses the bit map representations stored in the font memory for each of the erase characters contained in the page layout to generate an output data stream which is supplied to the erase unit.

BRIEF DESCRIPTION OF THE DRAWINGS

With the above as background, reference should now be made to the following detailed description of the preferred embodiment along with the accompanying drawings for a more detailed explanation of the invention, wherein.

DETAILED DESCRIPTION OF THE PREFERRED EMBODIMENT

Figure 1:
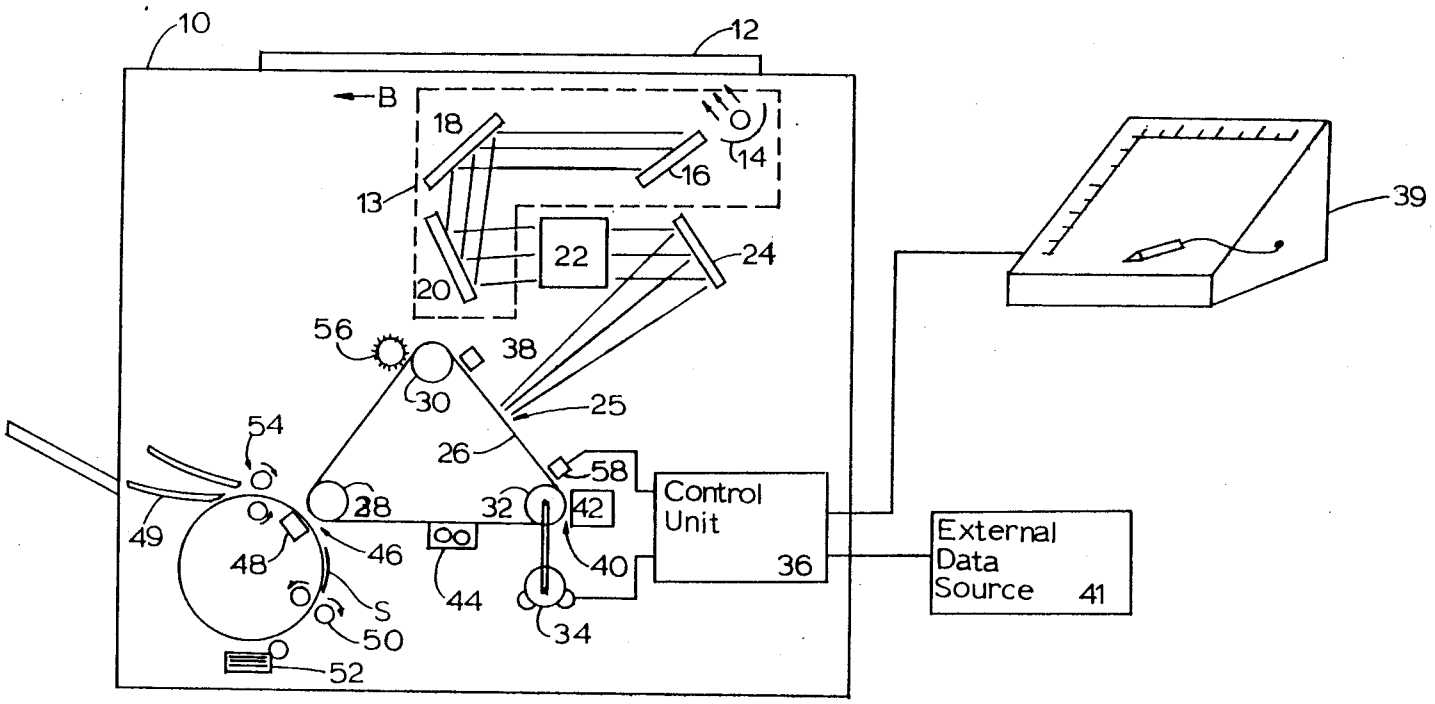
FIG. 1 is a schematic diagram of an electrophotographic reproduction apparatus made in accordance with the invention.

Referring now to FIG. 1, an electrophotographic reproduction apparatus 10 is shown that includes an original platen 12 constructed from a transparent material such as glass, an optical system 13 including an exposure lamp 14 and mirrors 16–18, a lens block 22, and a mirror 24. The optical system 13 reciprocates in the direction of arrow B underneath the original platen 12, in order to scan an original document placed on the original platen 12 by irradiating the original document with light from the exposure lamp 14 and transmitting light reflected from the original document to the lens block 22 via mirrors 16–18. The reflected light is transmitted through the lens block 22 for purposes of magnification or reduction, and then is reflected by mirror 24 onto a photoconductive web 26.

The photoconductive web 26 is trained about three transport rollers 28–32 to form an endless or continuous web. The photoconductive web 26 rotates about the transport rollers 28–32 when an activation potential is applied by a control unit 36 to a drive motor 34 that is coupled to transport roller 32 in a conventional manner. As the photoconductive web 26 rotates, it passes a series of electrophotographic work stations of the reproduction apparatus 10.

A charging station 38 is provided to sensitize the surface of the photoconductive web 26 by applying to its surface a uniform electrostatic primary charge of a predetermined voltage. The output of the charging station 38 is controlled by a grid connected to a programmable power supply (not shown). The power supply is in turn controlled by the control unit 36 to adjust the voltage level applied to the surface of the photoconductive web 26.

The photoconductive web 26 rotates from the charging station 38 to a first exposure station 25 where the reflected light from the original document is focused on the photoconductive web 26 by the mirror 24. The reflected light forms an electrostatic image on the photoconductive web 26 by modulating the primary charge applied to the surface of the photoconductive web 26 by the charging station 38.

A second exposure/erase station 40 is provided to further modify the primary charge applied to the photoconductive web 26 in order to alter the electrostatic image formed at the first exposure station 25. More specifically, a print head 42 is provided that includes a plurality of point-like radiation sources that are selectively energized by signals provided by the control unit 36, in order to selectively erase portions of the electrostatic image formed at the first exposure stations 25 or to add additional character information into portions of the electrostatic image. The control unit 36 controls the activation of the print head 42 in order to perform the selective erase operation based on coordinate data received from either a digitizer unit 39 that is coupled to the control unit 36 or some other external data source 41 as will be described in greater detail below.

The photoconductive web 26 then passes a development station 44 that includes a developer which may consist, for example, of iron carrier particles and electroscopic toner particles with an electrostatic charge opposite to that of the latent electrostatic image formed on the surface of the photoconductive web 26. The development station 44 includes a mechanism (not shown) for brushing or applying the developer over the surface of the photoconductive web 26 to form a toned image. Alternatively, the toner particles may have a charge of the same polarity as that of the latent electrostatic image and develop the image in accordance with known reversal development techniques.

After passing the development station 44, the photoconductive web 26 rotates past a transfer station 46 with a corona charger 48, at which time the toned image on the photoconductive web 26 is transferred to a copy sheet S that is supplied from a paper supply 52 via driver rollers 50. The copy sheet S is then transported to a heated pressure roller fuser 54 where the toned image is fixed to the copy sheet S. The copy sheet S is subsequently transported and discharged from the reproduction apparatus 10 via a transport mechanism 49.

Residual toner particles remaining after the toned image has been transferred from the photoconductive web 26 to the copy sheet S are removed from the photoconductive web 26 at a cleaning station 56. The cleaning station 26 is preferably located prior to the charging station 38 along the transport path of the photoconductive belt 26.

The photoconductive web 26 has a plurality of indicia, such as perforations along one of its edges, that are used to coordinate the operation of the various work stations with the movement of the photoconductive web 26. A sensor 58 is positioned at a suitable location along the transport path of the photoconductive web 26 to sense the perforations which are spaced at equal distances. Signals generated by the sensor 58 are supplied to the control unit 36 which controls the overall operation of the reproduction apparatus 10.

The control unit 36 includes a digital computing mechanism, preferably a microprocessor, that controls the operation of the reproduction apparatus 10 in response to various input signals from operator controls (not shown) and various sensors including sensor 58, etc., in accordance with a stored software operating program. The use of a microprocessor and a software program to control the basic operations of an electrophotographic reproduction apparatus is well known in the art and will not be discussed in detail. The particulars of any control program will of course depend on the architecture of the particular microprocessor employed and the specific structural arrangement of the components of the electro-photographic reproduction apparatus employed. The control of the operation of the second exposure/erase station 40 by the control unit 36, however, will be discussed in greater detail below with reference to FIG. 2.

Figure 2:
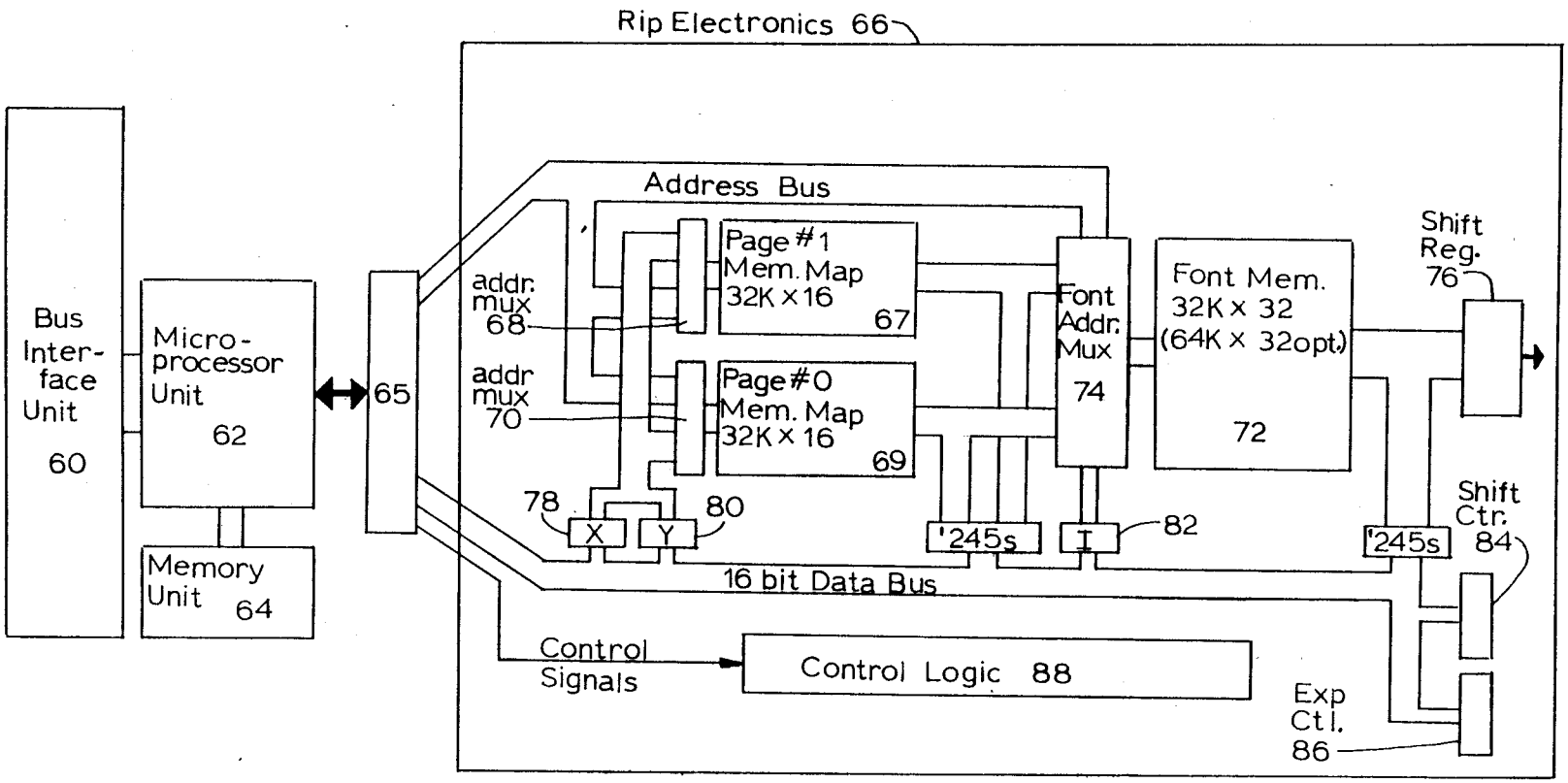
FIG. 2 is a schematic block diagram of a control unit employed in the reproduction apparatus illustrated in FIG. 1.

A simplified block diagram of the control unit 36 is illustrated in FIG. 2. The control unit 36 includes a microprocessor unit 62 that is coupled to a bus interface unit 60 and a memory unit 64. The bus interface unit 60 couples the microprocessor unit 62 to various devices such as operator controls and sensors, in order to provide various input signals to the microprocessor unit 62 to control the overall operation of the reproduction apparatus 10. The interface unit 60 also couples the microprocessor unit 62 to the digitizer 39 or to an external data source 41, such as an operator keyboard or PC, which supply information to the microprocessor unit 62 that is related to the operation of the second exposure/erase station 40. The microprocessor 62 is also coupled via a microprocessor interface 65 to raster image processing (RIP) electronics 66, which are used to control the operation of the print head 42.

The RIP electronics 66 includes two memory maps 67 and 69, respectively designated as Page #1 and Page #0, and their associated addressing units 68 and 70, a font memory unit 72 in which a plurality of character fonts and at least one erase font are stored, a font memory addressing unit 74, an output shift register 76, an X counter 78, a Y counter 80, an I counter 82, a shift timer 84, and an exposure timer 86. The overall operation of the RIP electronics 66 is controlled by control logic 88 which is coupled to the microprocessor unit 62. The control logic 88 can be implemented as a state machine using PLD logic. Alternatively, a microsequencer device such as the ALTERA EP488 or AMD PL141 can be employed to implement the control logic 88.

Figure 3:
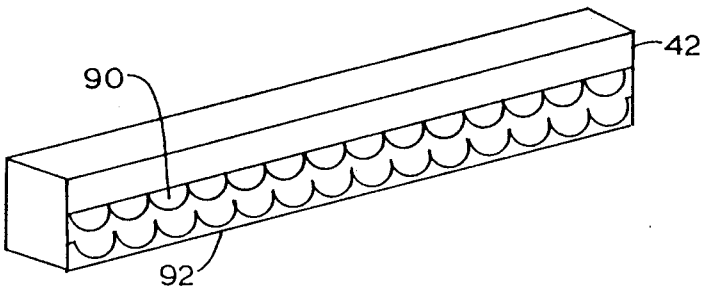
FIG. 3 illustrates a print head employed in the reproduction apparatus illustrated in FIG. 1.

The output shift register 76 is coupled to the print head 42 and converts parallel data received from the font memory unit 72 to a serial bit stream which is used to control the operation of the print head 42. As illustrated in FIG. 3, the print head 42 includes a plurality of independently energizable point-like radiation sources 90, preferably light-emitting diodes (LED's), and associated optics 92 may be provided for focusing the light from each of the sources 90 onto the photoconductive web 26. The print head 42 also includes buffers for receiving the serial bit stream from the output shift register 76 and drivers for independently driving each of the sources 90, the detailed operation of which is well known in the art. Preferably, the print head 42 has a resolution of at least 120 dots per inch (dpi).

Figure 4:
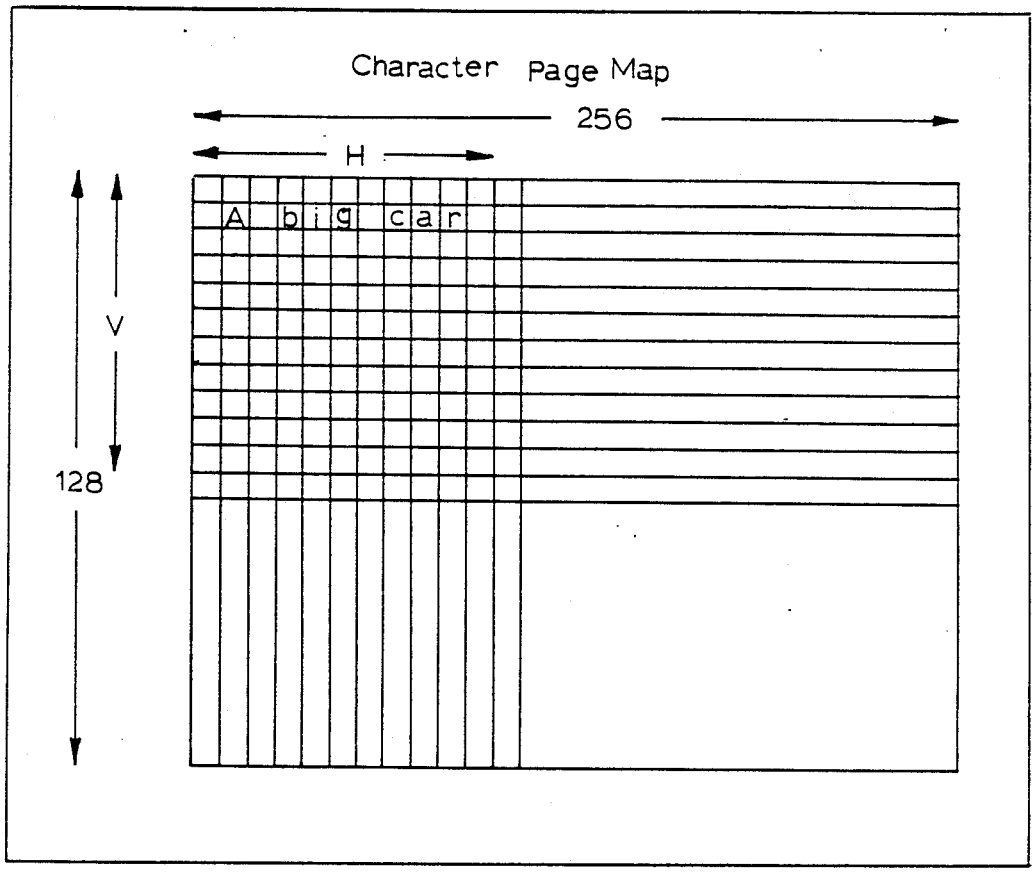
FIG. 4 illustrates a page memory employed in the control unit illustrated in FIG. 2.

The basic operation of the RIP electronics 66 is as follows. The microprocessor unit 62 fills one memory map, for example page #1, with the character representation of a page, i.e., a page layout. As illustrated in FIG. 4, the page memory is preferably arranged to allow up to 256 characters in the horizontal direction, and 128 characters in the vertical direction, each character being defined by a rectangular array S pixels wide and I pixels high (preferably S=12 and I=20). Only those character locations that will be printed need to be filled with valid data.

Figure 5:
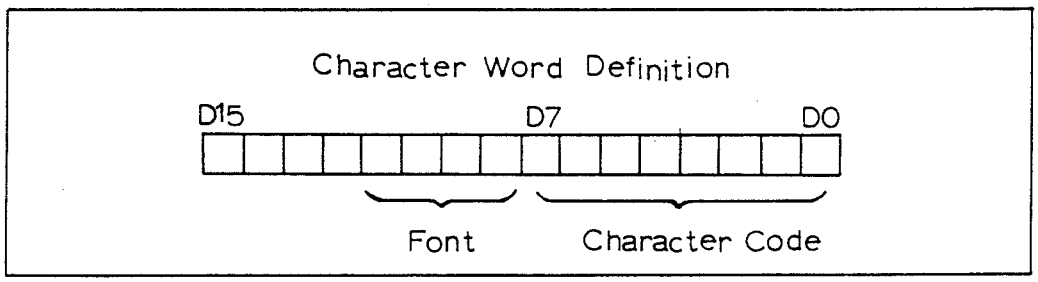
FIG. 5 illustrates a character word to be stored in the page memory of the control unit illustrated in FIG. 2.

The character representation can consist of alphanumeric characters (for example ASCII coded characters) supplied to the microprocessor unit 62 via an operator keyboard or some other external data source such as a PC, and/or erase characters which define an erase field one or more erase fields. Each character to be stored in the memory map includes a character word having a character code (either ASCII or a designated erase character code) and a font number as illustrated in FIG. 5. Bit map representations for each character code of each font number are stored in the font memory 72.

The bit map representations can be prestored if the font memory 72 is implemented using ROM devices. Alternatively, the bit map representations can be generated by the microprocessor unit 62 and stored in the font memory 72 upon initially applying power to the reproduction apparatus 10 if RAM devices are employed in the font memory. The tradeoff between the use of ROM and RAM for the font memory 72 depends on economic factors and the speed at which the microprocessor unit 62 is capable of generating the bit maps.

It is preferable, however, that the bit map representations for the erase characters be generated once the coordinates of the erase field are supplied to the microprocessor 62 via the digitizer 39 due to the shear number of possible permutations of required erase characters.

The RIP electronics 66 uses the X and Y counter to address the memory maps 67 and 69 to receive and store data from the microprocessor unit 62. Once one page becomes filled, the RIP electronics 66 switches page memories allowing the microprocessor unit 62 to fill the alternate block of page memory while the data contained in the first page memory is applied to the font memory 72. It should be noted that the data can be stored in the memory maps in either a portrait or landscape format and fonts associated with each format can be stored in the font memory 72 if desired.

The font memory 72 is constructed as a lookup table, the address of which is defined by the font number, plus the character code, plus the raster line number within the character cell. Thus, the character words from the page memories 67 and 69 are combined with the output of the I counter to address the bit map representation stored in the font memory, and the output of the font memory 72 is the parallel pixel data of the character that is supplied to the shift register. The shift register in turn converts the parallel pixel data to serial pixel data which is supplied to the print head 42.

The user defines a selective erase field by inputting the coordinant location of two diagonal corners of the selected erase field via the digitizer 39. The digitizer 39 preferably has a resolution equivalent to that of the print head 42 thereby enabling the dimensions of the erase field to be defined with a high degree of resolution, i.e., by any pixel within a character cell. The microprocessor unit 62 calculates the character map positions of the corners and edges of the erase field and constructs the font data for each of the require erase characters. A total of nine erase characters will be required, namely, one for each of the four corners of the erase field, one for each of the side edges of the erase field and a completely blocked character to fill in the balance of the erase field. The microprocessor unit 62 assigns a character code and font number to the bit map representations of the erase characters and stores the bit map representations into the font memory. The microprocessor unit 62 loads the memory map with a character representation of the erase field using the determined erase characters.

Figure 6:
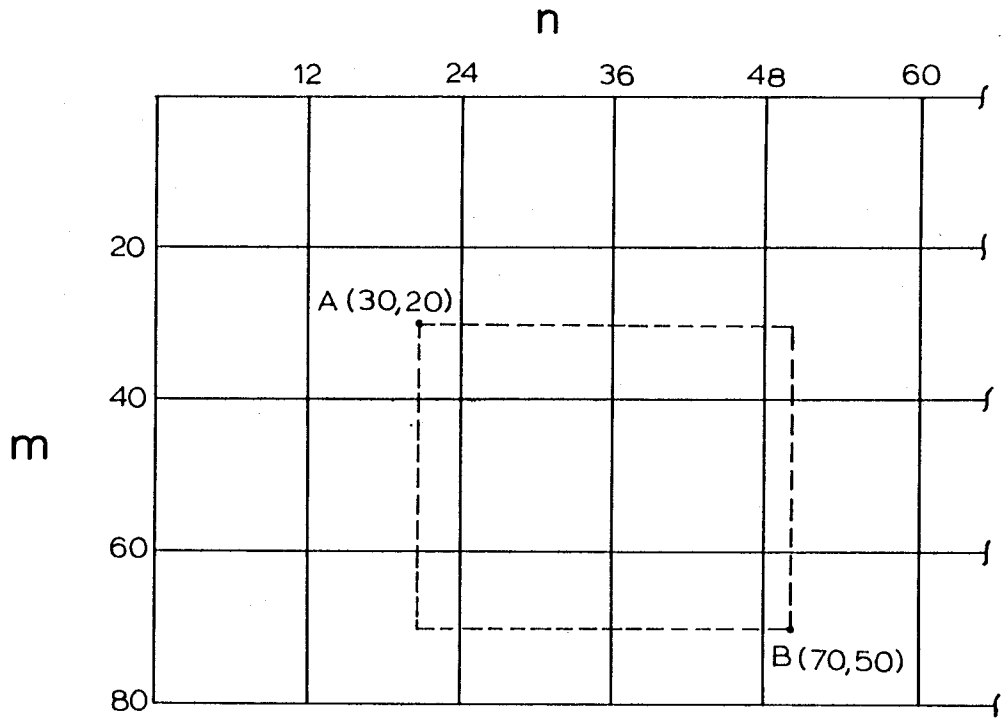
FIG. 6 illustrates a portion of the surface of a digitizer illustrated in FIG. 1.

An example of how the erase characters are generated is illustrated in FIG. 6 which shows a portion of the digitizer. A user selects two points A and B having digitizer coordinates (m,n) that are the locations of two diagonally opposite corners of an erase field. These coordinate locations are provided to the microprocessor unit 62 which first determines which corners of the erase field are represented by the selected points. For example, if the m coordinate value for point A is less than the m coordinate value of point B as illustrated in FIG. 6, then point A must represent an upper corner of the selected erase field. Further, if the n coordinate value of point A is less than the n coordinate value of point B, then point A must represent the upper left-hand corner of the selected erase field. Next, a bit map representation for the upper left hand corner erase character is generated by assigning a logic "1" to all locations in the character cell having a value of I greater than or equal to 10, the remainder of m divided by the length I of a character cell, and a value for S greater than or equal to 8, the remainder of n divided by the width S of a character cell. This erase character is assigned an eight bit character code which has been preselected for the upper left hand corner erase character and an erase font number, and the bit map representation is stored in the font memory. The remaining erase characters are similarly calculated and stored by the microprocessor unit 62. For example, the position of the upper right hand corner is easily determined by taking the m coordinate value of point A and the n coordinate value of point B.

The same process described above is repeated if additional erase fields are indicated by the operator selecting additional erase coordinates. In such a case, the set of erase characters corresponding to the second erase field are tagged with different erase character codes than the erase characters corresponding to the first erase field. In the preferred embodiment illustrated, the font memory 72 is arranged such that each font can contain 128 characters. Thus, a single erase font can contain the erase characters for 14 different erase fields, as each erase field requires only nine erase characters.

After the generation and storage of the erase characters is completed, the microprocessor unit 62 stores the character code representation of the erase field in the memory map. For example, at address X=0001 and Y=0002 which corresponds to the location of the upper left hand corner selected on the digitizer 38, the character word representing the upper right hand corner erase character is stored, at address X=0001 and Y=0003, the character word representing the upper edge erase character is stored, and so forth until the entire erase field is stored in the designated memory map.

As described above, the RIP electronics 66 then applies each of the character words stored in the memory map along with the output of the I counter 82 to address the font memory 72 and generates the output data stream which is supplied to the write head 42. The individual LEDs of the print head 42 are then selectively activated to erase a portion of the original image present on the photoconductive web 26 which corresponds to the selected erase field, and/or to selectively write additional image information to the photoconductive web 26. Thus, the above-described electrophotographic reproduction apparatus 10 provides the capability of imaging an original document, selectively erasing portions of the original document, and adding selected image information to the original document.

The invention has been described with reference to certain preferred embodiments therefore, it will be understood, however, that modifications and variations may be effected within the scope of the appended claims. For example, a set of erase characters or multiple sets of erase characters could be prestored in memory instead of generating the erase characters when the erase fields are defined. As there are a multitude of possible erase character permutations, averaging could be used to determine which erase character set best fits the indicated erase field although this would result in some loss of resolution. In addition, the invention is not limited to an electrophotographic reproduction apparatus or to such apparatus that employ conductive webs or the particular structural arrangement illustrated in FIG. 1.

What is claimed is:

1. An apparatus comprising:

image forming means for forming an image of an original document on a photosensitive medium;

input means for generating coordinate signals indicative of coordinates that correspond to at least one selected erase field;

control means for generating at least one set of erase characters based on said coordinate signals generated by said input means and for storing a bit map representation of each of said erase characters in a font memory; and erase means for erasing a portion of the image of the original document formed on said photosensitive medium that corresponds to said selected erase field in accordance with said bit map representation stored in said font memory;

wherein said control means includes means for generating and storing a page layout comprising a plurality of character words that define said erase field in response to said coordinate signals generated by said input means, each of said character words corresponding to one of said erase characters, and means for sequentially addressing said bit map representations stored in said font memory of said erase characters that correspond to each of the character words contained in said page layout to generate an output data stream that is supplied to said erase means.

2. An apparatus as claimed in claim 1, wherein said input means includes a digitizer tablet.

3. An apparatus as claimed in claim 1, wherein said erase means includes a print head comprising a plurality of independently energizable point-like radiation sources.

4. An image forming apparatus comprising:

a charging station that sensitizes a surface of an image receiving element by applying a uniform charge to the surface of said image receiving element;

an exposure station that focuses an image to be reproduced on said image receiving element thereby modulating the uniform charge applied to the surface of said image receiving element to form an electrostatic image thereon;

an exposure/erase station that further modifies the uniform charge applied to the surface of the image receiving element to alter the electrostatic image formed thereon by said exposure station;

a development station that develops the electrostatic image formed on said image receiving element;

a control unit that controls the operation of said charging station, said exposure station, said exposure/erase station and said development station, wherein said control unit generates at least one set of erase characters based on coordinate signals supplied by an input device which correspond to at least one erase field and stores bit map representations of said erase characters in a font memory, generates and stores a page layout comprising a plurality of character words arranged to define said erase field, and controls the operation of said exposure/erase station to selective erase a portion of said electrostatic image, which corresponds to said erase field, by selectively addressing said bit map representations stored in said font memory for each of the character words and supplying an output data stream indicative thereof to said exposure/erase station.

5. An apparatus as claimed in claim 4, wherein said image receiving element comprises a photoconductive web.

6. An apparatus as claimed in claim 5, further comprising a transfer station from transferring said electrostatic image from said photoconductive web to a copy sheet.

7. An apparatus as claimed in claim 4, where said font memory comprises ROM devices in which a plurality of fonts are stored.

8. An apparatus as claimed in claim 4, wherein said input device includes a digitizer tablet.

9. An apparatus as claimed in claim 4, wherein said exposure/erase station includes a print head comprising a plurality of independently energizable point-like radiation sources.

10. A method of operating an image forming apparatus comprising:

forming an image of an original document on a photosensitive medium with an image forming unit;

generating coordinate signals indicative of coordinates that correspond to at least one selected erase field with an input unit;

generating at least one set of erase characters based on said coordinate signals generated by said input unit and storing a bit map representations of each of said erase characters in a font memory;

generating and storing a page layout comprising a plurality of character words that define said erase field in response to said coordinate signals generated by said input unit, each of said character words corresponding to one of said erase characters; and erasing a portion of the image of the original document formed on said photosensitive medium that corresponds to said selected erase field by sequentially addressing said bit map representations of said erase characters stored in said font memory that correspond to said character words, generating an output data stream in response thereto, and supplying said data stream to an erase unit.

* * * * *